US006648603B2

(12) United States Patent
Dexter et al.

(10) Patent No.: US 6,648,603 B2
(45) Date of Patent: Nov. 18, 2003

(54) PRESSURE WASHER ENGINE IDLE CONTROLLER

(75) Inventors: S. Shane Dexter, Humboldt, TN (US); Burl Daniel, Pinson, TN (US)

(73) Assignee: Devilbiss Air Power Company, Jackson, TN (US)

( * ) Notice: Subject to any disclaimer, the term of this patent is extended or adjusted under 35 U.S.C. 154(b) by 34 days.

(21) Appl. No.: 09/776,812

(22) Filed: Feb. 5, 2001

(65) Prior Publication Data

US 2001/0033794 A1 Oct. 25, 2001

Related U.S. Application Data

(60) Provisional application No. 60/183,236, filed on Feb. 17, 2000.

(51) Int. Cl.[7] ..... F04B 49/08

(52) U.S. Cl. ..... 417/34; 417/234; 417/43; 417/53; 132/502

(58) Field of Search ..... 417/234, 34, 43, 417/53; 137/502

(56) References Cited

U.S. PATENT DOCUMENTS 930,158 A * 8/1909 Connet ..... 137/502
1,749,912 A 3/1930 Ferguson
2,509,078 A * 5/1950 Stover ..... 137/502
3,295,450 A 1/1967 Schönwald et al. ..... 103/25
3,811,792 A * 5/1974 Kennedy, Jr. ..... 417/28
3,825,187 A 7/1974 Tatge ..... 239/312
3,905,516 A 9/1975 Wisnia ..... 222/63
4,710,104 A * 12/1987 Dring ..... 417/342
4,825,747 A 5/1989 Bardin et al. ..... 91/165
5,035,580 A * 7/1991 Simonette ..... 417/34
5,174,723 A * 12/1992 Groger et al. ..... 417/26
5,244,351 A * 9/1993 Arnette ..... 137/202
5,529,460 A 6/1996 Eihusen et al. ..... 417/20
5,848,877 A * 12/1998 Dill et al. ..... 417/15

* cited by examiner

*Primary Examiner*—Charles G. Freay
*Assistant Examiner*—Emmanuel Sayoc
(74) *Attorney, Agent, or Firm*—MacMillan, Sobanski & Todd, LLC

(57) ABSTRACT

An engine idle controller for an engine driven pressure washer. The pressure washer delivers high pressure water from a pump through the idle controller to a conventional wand which includes a manually operated, normally closed flow control valve and a spray nozzle. When the wand valve is opened, a resulting pressure drop between two chambers in the flow controller acts on a piston to move the engine throttle to a full throttle position. When the wand valve is closed, the pressures in the chambers equalize and the piston is moved to a position to set the engine throttle to an idle position.

9 Claims, 4 Drawing Sheets

PRESSURE WASHER ENGINE IDLE CONTROLLER

CROSS-REFERENCE TO RELATED APPLICATIONS

Applicants claim priority to U.S. Provisional Patent Application Ser. No. 60/183,236 filed Feb. 17, 2000.

STATEMENT REGARDING FEDERALLY SPONSORED RESEARCH OR DEVELOPMENT

Not Applicable.

TECHNICAL FIELD

The invention relates to engine driven pressure washers and more particularly to an engine idle controller for an engine driven pressure washer.

BACKGROUND OF THE INVENTION

A pressure washer includes an electric motor or an engine driven high pressure liquid pump. Generally, the pump has a water inlet which is connected through a hose to a water main. Optionally, a suitable cleaning solution may be mixed with the water either at the pump or upstream or downstream from the pump. The pump increases pressure of the water or other liquid from a relative low inlet pressure to a significantly higher outlet pressure. The high pressure water is delivered to a wand for directing a water spray at a surface to be cleaned. Normally, the wand includes a manually operated trigger valve for turning the water flow on and off, and a nozzle which shapes the spray pattern and determines the velocity of the high pressure spray. When the valve is closed, the pump can be subjected to a high static load. An unloader valve may be provided for allowing the pump to continue to operate by recirculating the water through the unloader valve back to the inlet to the pump. However, a typical unloader valve may still place a sufficient back load on the pump to cause excess heat buildup and excess wear on the motor and pump. When the pump is driven by an electric motor, a pressure responsive switch may be provided between the pump and the wand for stopping the motor while the water discharge valve is closed to prevent excess wear on the motor and pump, excess heat generation and unnecessary energy consumption. When the water pressure to the wand drops in response to opening the wand trigger valve, the motor is immediately restarted. This approach will not work when a gasoline engine is used to drive the pressure washer pump, since an engine cannot be restarted as quickly as a motor. Consequently, an unloader valve is used with engine driven pressure washers, and the engine and pump are operated against the constant back load of the unloader valve when the trigger valve is closed.

BRIEF SUMMARY OF THE INVENTION

According to the invention, an idle controller is provided for an engine driven pressure washer. Although an engine cannot be stopped and restarted with sufficiently fast response to the operation of a trigger valve, the engine speed can be quickly changed in response to water flow and pressure demands. When the trigger valve on the wand is closed to stop the water spray, the controller senses the cessation of water flow to the wand and moves the engine throttle to an idle position. When the trigger valve is opened, the limited water flow to the wand produced by the idling engine is sufficient for the controller to return the engine to full throttle. The pump may include a small bypass passage connecting the pump inlet and outlet together. The bypass passage is sized to carry the limited water flow produced by the pump when the engine is idling. The passage will not carry the significantly higher water flow from the pump when the engine is operated at full throttle. If desired, the bypass passage can include a valve which is opened by the engine idle controller when the engine is set to idle and is closed by the engine idle controller when the engine is set to full throttle. Alternately, the engine may be provided with a centrifugal clutch which reduces but does not totally eliminate the load from the pump on the idling engine. The engine is sufficiently coupled through the centrifugal clutch to the pump during idle to cause the pump to operate with the trigger valve is opened to produce a sufficient water flow to the wand for operating the idle controller.

Accordingly, it is an object of the invention to provide an engine idle controller for an engine driven pressure washer.

Other objects and advantages of the invention will become apparent from the following detailed description of the invention and the accompanying drawings.

DETAILED DESCRIPTION OF THE INVENTION

Figure 1:
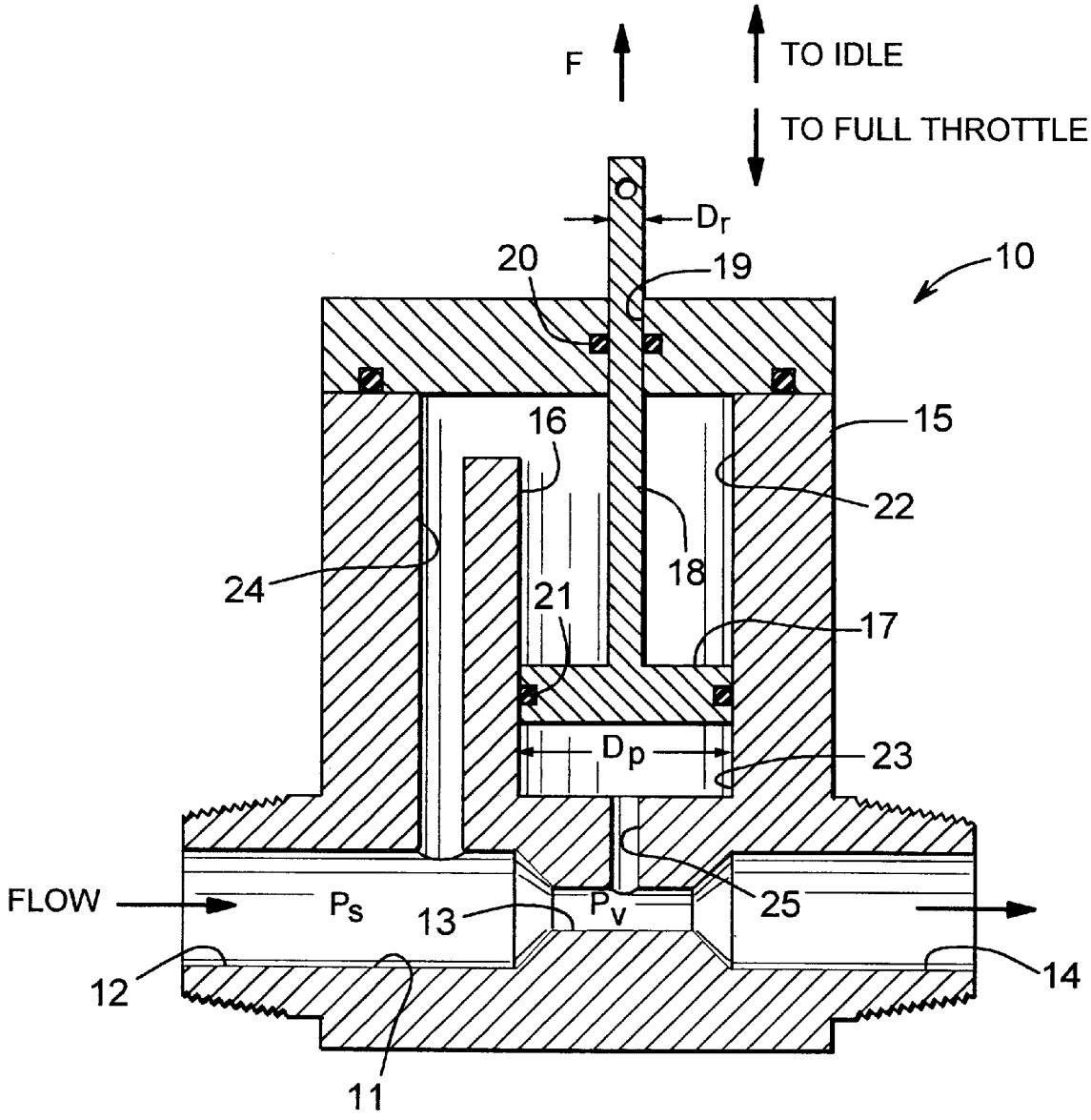
FIG. 1 is a cross sectional view through a pressure washer engine idle controller according to a first embodiment of the invention.

Referring to FIG. 1, an engine idle controller 10 for an engine driven pressure washer is shown according to a first embodiment of the invention. The pressure washer is described herein for spraying water. However, as used herein, the term "water" shall encompass other liquids which are sprayed with pressure washers, such as a mixture of water and a liquid cleaning chemical such as a soap or a solvent. The controller 10 includes a liquid passage 11 through which pressurized water flows from a pump to a wand (not shown). The wand may be of a conventional design which typically includes a trigger operated water flow control valve (not shown) for controlling the discharge of a water spray and a water discharge nozzle (not shown). Pressurized water will flow through the passage 11 only when the trigger valve is opened. Such a wand is shown, for example, in U.S. Pat. No. 3,825,187, the disclosure of which is incorporated herein. The wand illustrated in that patent has a plurality of interchangeable nozzles for allowing selection of several different spray patterns.

The water passage 11 includes an inlet end 12, a restriction or venturi 13 and an outlet end 14. The water passage 11 is formed in a controller housing 15. The housing 15 forms a cylinder 16 having an axis. A piston 17 is mounted to slide in an axial direction in the cylinder 16. A rod 18 extends from the piston 17 through an passage 19 through the housing 15 to slide in an axial direction when the piston 17 moves in the cylinder 16. An o-ring seal 20 prevents leakage of pressurized water between the rod 18 and the walls of the housing passage 19 without inhibiting the rod 18 from being moved in an axial direction by the piston 17. The piston 17 also may include an o-ring or piston ring seal 21 which limits pressurized water leakage between the piston 17 and the cylinder 16 while permitting the piston 17 to slide in an axial direction. As shown in FIG. 1, the piston 17 has a diameter $D_p$ and the rod 18 has a diameter $D_r$.

The piston 17 divides the cylinder 16 into two chambers, a chamber 22 through which the rod 18 extends and a chamber 23. A passage 24 connects the chamber 22 to the inlet side 12 of the pressurized water passage 11 and a passage 25 connects the venturi 13 in the pressurized water passage 11 to the chamber 23. Thus, the chamber 22 will be exposed to the water pressure $P_s$ which is in the inlet side 12 of the pressurized water passage 11 and the chamber 23 will be exposed to the water pressure $P_v$ in the venture 13.

In operation, the water pressures in the chambers 22 and 23 will depend on the water flow through the passage 11. When the trigger valve is closed, the venturi water pressure $P_v$ equals the inlet water pressure $P_s$. Consequently, both chambers 22 and 23 see the same water pressure. This pressure will act of an area equal to the area of the rod 18, or $(\pi D_r^2)/4$ to move the piston and extend the rod 18 from the housing 15. The rod 18 is connected to the engine throttle (not shown) to move the throttle to idle when the rod 18 is extended from the housing 15.

When the trigger valve on the wand is opened, the pressurized water will begin to flow through the passage 11. As a consequence of the water flow, the water pressure $P_v$ in the venturi 13 will drop below the inlet pressure $P_s$. Consequently, the water pressure in the chamber 23 will be below the water pressure in the chamber 22 and the piston 17 will move to pull the rod 18 further into the housing 15. As the rod 18 is pulled further into the housing 15, the engine throttle which is connected to the rod 18 is moved to full throttle. The force F acting to push the rod 18 from the housing can be calculated using the formula:

$$F=(\pi/4)[P_s(D_p^2-D_r^2)-P_v(D_p^2)]$$

Figure 2:
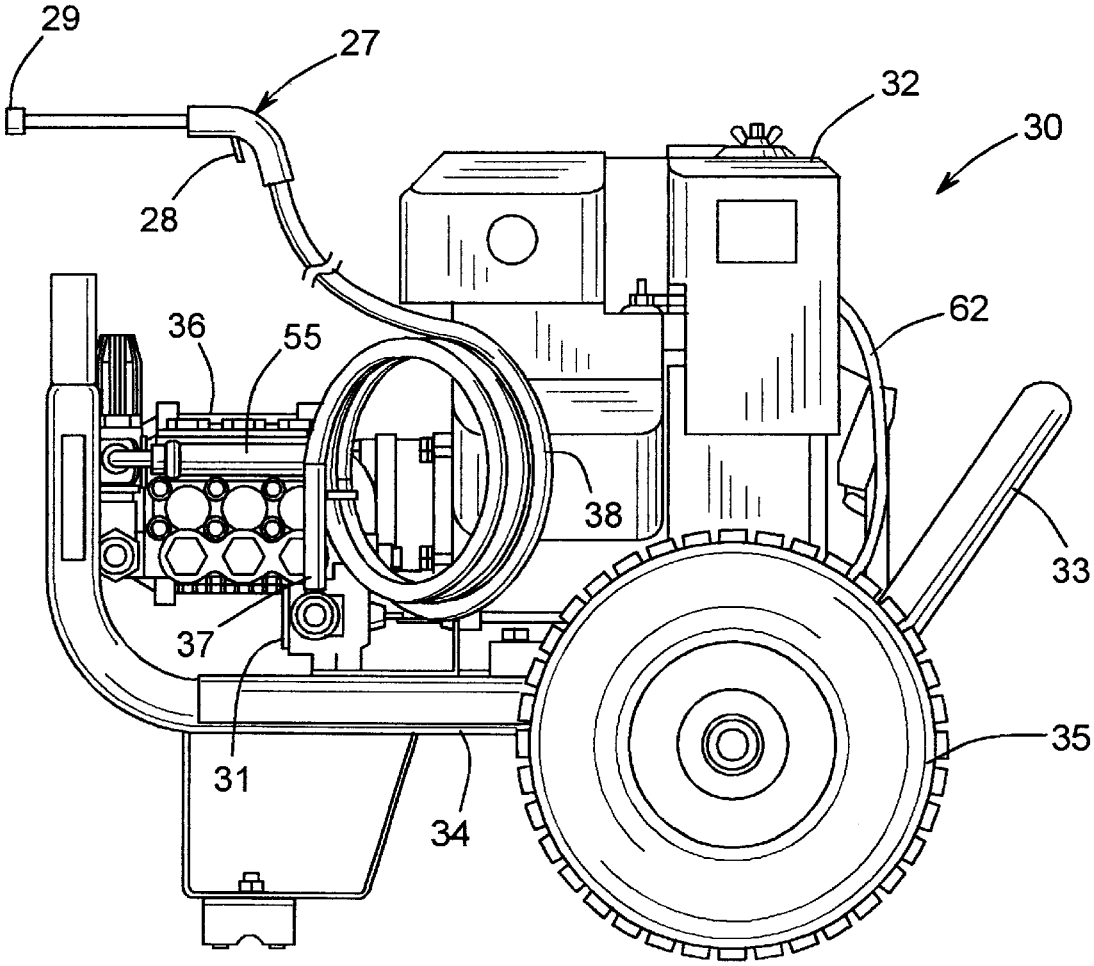
FIG. 2 is a side elevational view of an engine driven pressure washer with an engine idle controller according to a second embodiment of the invention.

FIG. 2 is a side elevational side view of an exemplary engine driven pressure washer 30 which includes an engine idle controller 31 according to a modified embodiment of the invention. The pressure washer 30 may be of various know designs and may include a gasoline operated engine 32 mounted on a cart 33 having a frame 34 supported on wheels 35. A high pressure liquid pump 36 is connected to be driven by the engine 32. The high pressure water outlet from the pump 36 is connected through the engine idle controller 31 to an inlet end 37 of a hose 38. A discharge end of the hose 38 is connected to a conventional wand 27, which includes a normally closed, manually operated trigger valve 28 for controlling liquid flow to a nozzle 29. If desired, a handle assembly (not shown) may be attached to the cart frame 34 to facilitate moving the cart 33. The handle assembly also may include brackets or other known construction for storing the wand and the hose 38 when the pressure washer 30 is not in use or is being moved.

Details of the engine idle controller 31 are shown in FIGS. 3–6. The idle controller 31 includes a housing 39 which defines a cylinder 40 in which a piston 41 is located to slide in an axial direction 42. The cylinder 40 is closed by a plug 43 which is threaded into the housing 39. The piston 41 divides the cylinder 40 into a first chamber 44 and a second chamber 45. Either a limited clearance is provided between the piston 41 and the cylinder 40 or one or more calibrated holes 43 may be provided in the piston 41 to allow water to flow from the chamber 44 to the chamber 45, while providing some restriction to such water flow. A rod 46 is secured to the piston 41 to extend from the piston 41 through the first chamber 44 and to extend through an axially directed passage 47 through the housing 39. A projecting end 48 of the rod 46 is adapted to be connected in a conventional manner to operate the throttle (not shown) of the engine 32 which drives the pressure washer pump 36. One or more liquid seals 49 are provided between the rod 46 and the walls of the housing passage 47. The seals 49 prevent leakage of pressurized water from the chamber 44 between the rod 46 and the housing 39, without significantly restricting axial movement of the rod 46.

Pressurized water from the pump 36 is delivered through a suitable hose or tube 55 to an inlet 50 on the housing 39 for delivering pressurized water to the first chamber 44. The exterior end of the inlet 50 may be provided with threads 51 or with a nipple or other known configuration for connecting the pressurized water a hose or tube from the pump 36. The second chamber 45 connects to a pressurized water outlet 52 which is connected to the inlet end 37 of the hose 38 in a conventional manner. For example, the outlet 52 may have a threaded end 53 adapted to receive a nipple 54 (FIG. 3) to which the hose end 37 is secured.

Figure 3:
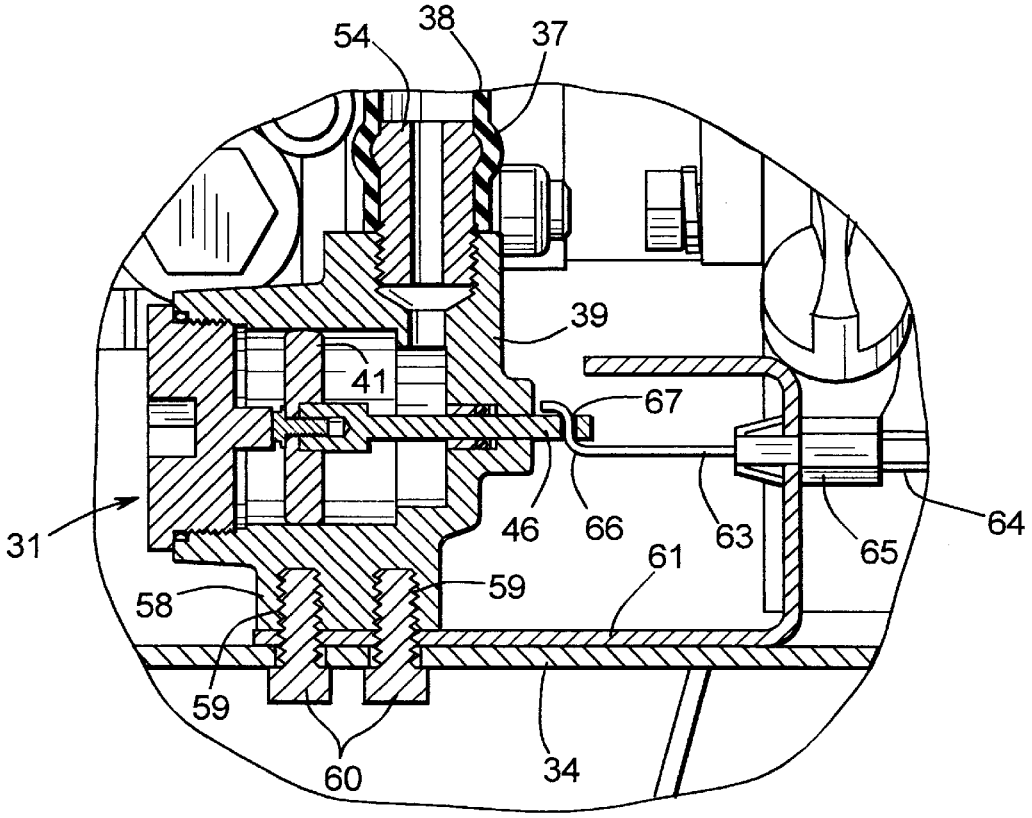
FIG. 3 is a fragmentary cross sectional view showing details of the engine idle controller on the pressure washer of FIG. 2.
Figure 4:
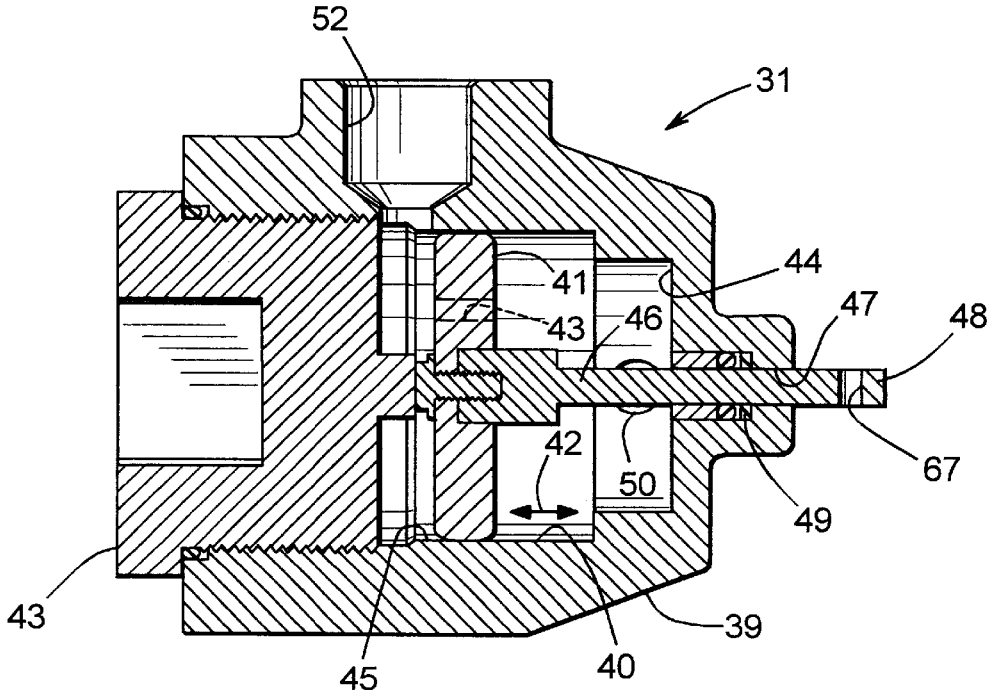
FIG. 4 is an enlarged cross sectional view through the pressure washer engine idle controller of FIG. 3.
Figure 5:
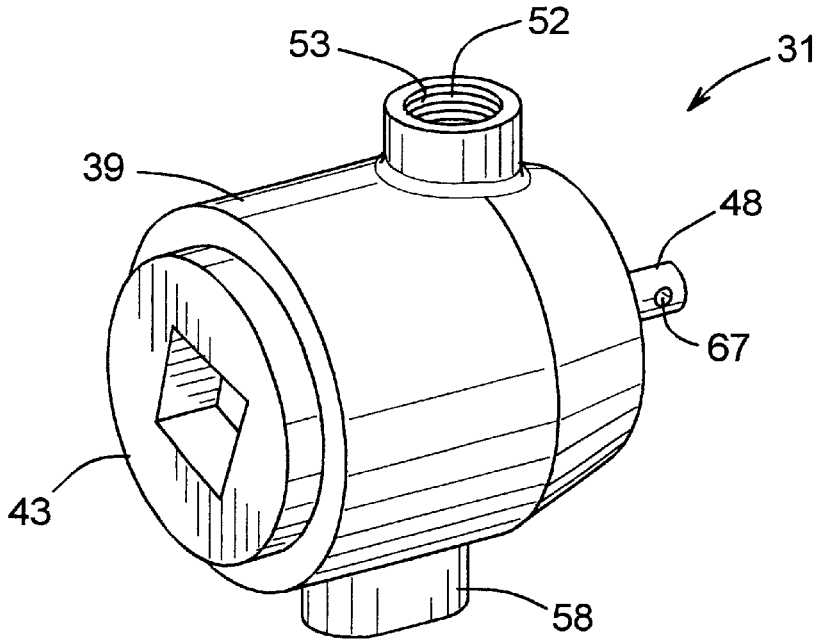
FIG. 5 is a perspective view of the engine idle controller of FIG. 3, as seen from one side.
Figure 6:
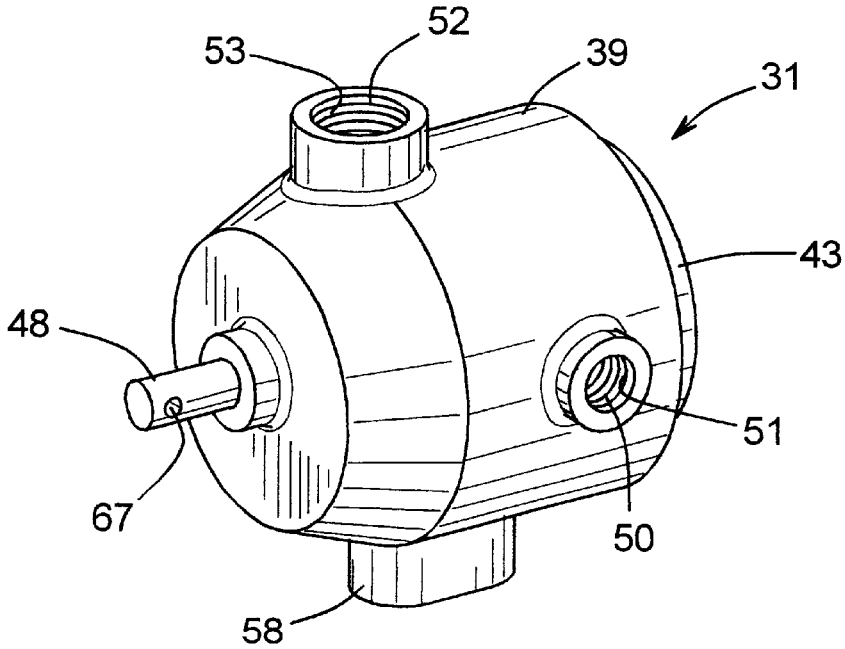
FIG. 6 is a perspective view of the engine idle controller, as seen from an opposite side from FIG. 5.

As seen in FIGS. 3, 5 and 6, the housing 39 includes a mounting foot 58 which has two threaded blind holes 59. Bolts 60 engage the holes 59 to secure the idle controller 31 to the cart frame 34. A bracket 61 is clamped between the foot 58 and the cart frame 34. As seen in FIGS. 2 and 3, the engine 32 has a flexible throttle cable 62 which has an end (not shown) connected in a conventional manner to control the engine throttle for adjusting the engine speed. The cable 62 is of conventional design, having a throttle control wire 63 which can be moved in an axial direction within a stationary outer sheath 64. The sheath 64 has an end 65 which is secured to the bracket 61 so that an end 66 of the throttle control wire 63 is substantially in axial alignment with the idle controller rod 46. The end 66 of the throttle control wire 63 is connected to the rod end 48, for example, by securing to a hole 67 in the rod end 48. It should be appreciated that the engine idle controller 31 may be mounted at any convenient location, such as on the high pressure water pump 36, on the engine 32 or on the cart frame 34, as shown. It also should be appreciated that other mounting arrangements for the idle controller 31 will be apparent to those skilled in the art.

When the water control valve 28 on the wand 27 is opened to initiate spraying from the nozzle 29, pressurized water flows from the inlet 50 through the first chamber 44, past the piston 41 to the second chamber 45, and through the outlet 52 and the hose 38 to the wand 27. The water flow creates a higher pressure in the chamber 44 than in the chamber 45 due to the flow resistance at the piston 41. The pressure differential between the chambers 44 and 45 moves the piston 41 to the position illustrated in FIGS. 3 and 4. When the piston 41 is in the illustrated position, the engine throttle is set to full throttle and the engine driven pump 36 delivers maximum water pressure and flow to the wand 27. When the wand valve 28 is closed, the water flow through the engine idle controller 31 ceases. When there is no water flow through the engine idle controller 31, the pressures in the chambers 44 and 45 equalize. Since the rod 46 covers a portion of the surface area of the piston 41, the pressure in the second chamber 45 acts on a larger area than the pressure in the first chamber 44. The pressure within the chamber 45 acts on the area of the rod 46 in the passage 47 to produce a sufficient force to move the piston 41 and the rod 46 to the right in FIGS. 3 and 4. The rod 46 is moved so that the rod end 48 is moved to project further from the housing 39, thus moving the engine throttle from the full throttle position to an idle position. While the engine is idling, a lower water pressure will be maintained within the chambers 44 and 45. When the wand valve is again opened, there will be a sufficient water flow through the idle controller 31 to create a pressure drop in the second chamber 45 which is sufficient to move the engine throttle to the "run" or full throttle position.

It should be appreciated that the force produced on the rod 46 for moving the engine throttle from idle to a full throttle position is determined by the pressure drop between the chambers 44 and 45 when the wand valve 28 is initially opened and the area of the piston 41. The force produced on the rod 46 for moving the engine throttle to an idle position is determined by the area of the rod 46 in the passage 47 and the pressure in the chamber 45 when the wand valve 28 is initially closed. Thus, the diameter of the piston 41, the flow restriction at the piston 41 and the diameter of the rod 46 may be selected to provide desired forces for moving the throttle wire 63. If necessary, it will be apparent that a spring (not shown) may be added to the engine idle controller 31 to provide additional force to assist moving the rod 46 to one of the full throttle or idle positions.

In the embodiment of FIG. 1, the venturi 13 is provided as a flow restriction between the water inlet and outlet to provide a pressure which is the same as the inlet pressure when there is no water flow between the inlet and outlet and to provide a reduced pressure when there is water flow between the inlet and outlet to the engine idle controller 10. In the embodiment of FIGS. 2–6, the flow restriction is described as being either a clearance between the piston 41 and the cylinder 40 or one or more passages 43 through the piston 41. It should be noted that a relatively small clearance may be provided between the piston 41 and the cylinder 40 and that a passage with a calibrated orifice or other flow restriction (not shown) may be provided either in or external to the housing 39 to extend between the chambers 44 and 45 or between the inlet 50 and the outlet 52. Such a flow restriction is selected to provide a desired water flow between the inlet 50 and outlet 52, while providing a desired reduced pressure in the chamber 45 in response to water flow to the wand.

It will be appreciated that various modifications and changes may be made to the above described preferred embodiment of an engine idle controller for an engine driven pressure washer without departing from the scope of the following claims.

What is claimed is:

1. An engine idle controller adapted to be connected in a pressurized liquid delivery path of a pressure washer between an engine driven pump and a wand having a liquid flow control valve and a spray nozzle, said engine idle controller including a housing defining a cylinder and a rod passage extending from said cylinder through said housing, a piston positioned in said cylinder, a rod having a first end connected to said piston and having a second end extending through said rod passage and projecting exterior to said housing, said piston and rod being mounted to slide in said housing between first and second positions, said piston dividing said cylinder into first and second chambers, said projecting rod second end being adapted to be connected to move an engine throttle on a pressure washer between an idle setting when in said first position and full throttle settings when in said second position, said engine idle controller having an inlet adapted to receive pressurized liquid from the pump, an outlet adapted to be connected to the wand, a flow restriction located between said inlet and said outlet and being adapted to create on an outlet side of said flow restriction a reduced pressure in pressurized liquid flowing between said inlet and said outlet and substantially the inlet liquid pressure when liquid does not flow between said inlet and said outlet, wherein the pressure at said inlet is applied to said first chamber and wherein the pressure at said outlet side of said flow restriction is applied to said second chamber.

2. An engine idle controller for use with a pressure washer, as set forth in claim 1, wherein said flow restriction is a venturi, and including a first passage in said housing connecting between said inlet and said first chamber, and a second passage in said housing connecting between said venturi and said second chamber.

3. An engine idle controller for use with a pressure washer, as set forth in claim 2, and further including a first seal between said piston and said cylinder adapted to limit liquid flow between said piston and said cylinder, and a second seal between said housing and said rod and adapted to prevent liquid flow through said passage between said rod and said housing, and wherein said first and second seals do not significantly inhibit movement of said piston and rod between said first and second positions.

4. An engine idle controller for use with a pressure washer, as set forth in claim 1, wherein said inlet connects to said first chamber, and said outlet connects to said second chamber.

5. An engine idle controller for use with a pressure washer, as set forth in claim 4, and wherein said flow restriction includes said piston.

6. An engine idle controller for use with a pressure washer, as set forth in claim 5, and wherein said flow restriction comprises a predetermined clearance between said piston and said cylinder.

7. An engine idle controller for use with a pressure washer, as set forth in claim 5, and wherein said flow restriction comprises at least one passage through said piston.

8. An engine idle controller adapted to be connected in a pressurized liquid delivery path of a pressure washer between an engine driven pump and a wand having a liquid flow control valve and a spray nozzle, said engine idle controller including a piston mounted in a housing to move between first and second positions, means adapted to position an engine throttle at an idle setting when said piston is in said first position and at a full throttle setting when said piston is in said second position, means responsive to static liquid pressure in said engine idle controller for positioning said piston in said first position when liquid is not flowing through said engine idle controller, and means for positioning said piston in said second position in responsive to liquid flow through said engine idle controller.

9. A method for controlling the speed of an engine in a pressure washer having an engine driven liquid pump and a wand having a flow control valve, said method comprising the steps of:

a) sensing the flow of pressurized liquid from said pump to said wand;

b) increasing the engine speed from an idle speed to a maximum speed in response to a sensed predetermined liquid flow from said pump to said wand; and c) decreasing the engine speed from the maximum speed to an idle speed in response the a sensed cessation of liquid flow from said pump to said wand.

* * * * *

UNITED STATES PATENT AND TRADEMARK OFFICE

CERTIFICATE OF CORRECTION

PATENT NO. : 6,648,603 B2
APPLICATION NO. : 09/776812
DATED : November 18, 2003
INVENTOR(S) : Dexter et al.

It is certified that error appears in the above-identified patent and that said Letters Patent is hereby corrected as shown below:

Inventor name, Burl Daniel, should be --William B. Daniel--

Signed and Sealed this

Twenty-fifth Day of March, 2008

JON W. DUDAS
*Director of the United States Patent and Trademark Office*